US012228014B2

(12) United States Patent
Aljishi et al.

(10) Patent No.: US 12,228,014 B2
(45) Date of Patent: Feb. 18, 2025

(54) VOLUMETRIC TREATMENT FLUID DISTRIBUTION TO REMOVE FORMATION DAMAGE

(71) Applicant: SAUDI ARABIAN OIL COMPANY, Dhahran (SA)

(72) Inventors: Mohammad Aljishi, Alqatif (SA); Fuad Alsultan, Alahsa (SA); Keshabananda Baruah, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 979 days.

(21) Appl. No.: 17/186,608

(22) Filed: Feb. 26, 2021

(65) Prior Publication Data

US 2022/0275707 A1 Sep. 1, 2022

(51) Int. Cl.

| | |
|---|---|
| ***E21B 37/00*** | (2006.01) |
| ***E21B 41/00*** | (2006.01) |
| ***E21B 47/04*** | (2012.01) |
| ***E21B 47/12*** | (2012.01) |
| ***E21B 49/00*** | (2006.01) |
| ***E21B 49/08*** | (2006.01) |

(52) U.S. Cl.

CPC ..... *E21B 37/00* (2013.01); *E21B 41/0078* (2013.01); *E21B 47/04* (2013.01); *E21B 47/12* (2013.01); *E21B 49/005* (2013.01); *E21B 49/087* (2013.01); *E21B 2200/20* (2020.05)

(58) Field of Classification Search

CPC ..... E21B 37/00; E21B 41/0078; E21B 47/04; E21B 47/12; E21B 49/005; E21B 49/087

USPC ..... 705/10

See application file for complete search history.

(56) References Cited

U.S. PATENT DOCUMENTS 9,670,753 B2 * 6/2017 Filippov ..... E21B 49/00
2002/0153137 A1 10/2002 Ziauddin et al.

(Continued)

FOREIGN PATENT DOCUMENTS

WO WO-0210546 A2 * 2/2002 ..... E21B 21/16

OTHER PUBLICATIONS

AKinsete_2016 (Effects of Mud Filtrate Invasion on Well Log Measurements, 2016). (Year: 2016).*

(Continued)

*Primary Examiner* — Brian S Cook

(74) *Attorney, Agent, or Firm* — Osha Bergman Watanabe & Burton LLP

(57) ABSTRACT

A system for selective fluid treatment of formation areas to remove formation damage may include an access module configured to access log data associated with a well. The system may include one or more hardware processors configured to identify a formation area as a treatment candidate area based on at least one of a permeability value associated with the formation area or a porosity value associated with the formation area. The one or more hardware processors may be configured to determine, based on reservoir modelling, a current depth of invasion value associated with the formation area, determine a volume of drilling mud buildup in the formation area based on the current depth of invasion value, and determine a treatment fluid volume value that identifies a volume of treatment fluid for application to the formation area to remove the formation damage from the formation area during a formation damage removal process.

20 Claims, 7 Drawing Sheets

(56) References Cited

U.S. PATENT DOCUMENTS

| | | | | |
|---|---|---|---|---|
| 2007/0244681 | A1 | 10/2007 | Cohen et al. | |
| 2016/0070019 | A1 | 3/2016 | Wu | |
| 2019/0094405 | A1* | 3/2019 | Itskovich | G01V 3/28 |

OTHER PUBLICATIONS

Amro_2002 (Laboratory Study and Field Matching of Matrix Acidizing of Petroleum Reservoir Rocks, J. King Saud Univ., vol. 14, Eng. Sci., (1), pp. 119-136, Riyadh A. H. 1422/2002) (Year: 2002).*

Riberio_2014 (A new Approach to Calculate Mud Invasion in Reservoirs Using Well Logs, Revista Brasileira De Geofiscica (2014) 32(2): 215-223) (Year: 2014).*

Windarto_2011 (Modeling of Mud Filtrate invasion and damage zone formation, Journal of Petroleum Science and Engineering 77 (2011) 359-364 (Year: 2011).*

Petrov, Alexander et al., "Advanced Petrophysical Log Suite Support for Acid Stimulation Design Optimization", SPE-191697-18RPTC-MS, Society of Petroleum Engineers, Oct. 2018, pp. 1-10 (10 pages).

"Chapter 5: Reservoir Engineering", Standard Handbook of Petroleum and Natural Gas Engineering, Third Edition, Elsevier Inc., 2015, pp. 5-1-5-291 (291 pages).

Ghommem, Mehdi et al., "Monitoring of Matrix Acidizing by Using Resistivity Measurements", SPE-181414-MS, Society of Petroleum Engineers, Sep. 2016, pp. 1-19 (19 pages).

Al Rbeawi, S et al., "Optimum matrix acidizing: How much does it impact the productivity", International Conference on Materials Engineering and Science, IOP Publishing, vol. 454, 2018, pp. 1-11 (11 pages).

* cited by examiner

VOLUMETRIC TREATMENT FLUID DISTRIBUTION TO REMOVE FORMATION DAMAGE

BACKGROUND

In the petroleum industry, formation damage is a condition often caused by wellbore fluids used during drilling, completion, or workover operations. The damage may be caused by solids that migrate and block pores in the formation, or by drilling fluids that alter the properties of reservoir fluids. For example, a residue (hereinafter also "drilling mud," "mudcake," "mud filtrate," or "filtercake") is deposited on a permeable medium, such as reservoir rocks, when a slurry, such as a drilling fluid, is forced against the permeable medium under a pressure. The mudcake impairs the permeability of the reservoir rocks, thereby reducing the natural productivity of reservoirs. The formation damage, in some instances, affects only the near-wellbore region of a well and reaches only a few inches from the rock face of the bore-hole wall. However, in other instances, the formation damage can extend deep into the formation. Because formation damage often has a negative effect on the production of a well by reducing the recovery of oil and gas from the well, well operators may employ one or more mechanisms to improve the production of wells affected by formation damage.

A technique sometimes used to remedy formation damage is the treatment of the reservoir rocks with acid to improve rock quality. Although this conventional acid stimulation approach may enhance the performance of a well, a problem with this conventional technique is the overtreating formation beds by applying the same acid volume to a plurality of zones of the open-hole section without regard to the properties of the rocks in various areas of the reservoir. Accordingly, there is a need for a system that provides improvements over the conventional acid stimulation systems by using an efficient approach for selective formation treatment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a method for selective fluid treatment of formation areas to remove formation damage. The method includes accessing log data associated with a well. The log data includes at least one of permeability values or porosity values associated with a plurality of formation areas. The method includes identifying, using a hardware processor, a formation area of the plurality of formation areas as a treatment candidate area based on at least one of a permeability value associated with the formation area exceeding a permeability threshold value or a porosity value associated with the formation area exceeding a porosity threshold value. The method includes determining, using the hardware processor and based on reservoir modelling, a current depth of invasion value associated with the formation area. The current depth of invasion value indicates a time-dependent dynamic invasion by drilling mud into the formation area. The method includes determining, using the hardware processor, a volume of drilling mud buildup in the formation area based on the current depth of invasion value. The method includes determining, using the hardware processor, a treatment fluid volume value that identifies a volume of treatment fluid for application to the formation area to remove the formation damage from the formation area during a formation damage removal process. The determining of the treatment fluid volume value is based on the volume of drilling mud buildup in the formation area.

In general, in one aspect, embodiments disclosed herein relate to a system for selective fluid treatment of formation areas to remove formation damage. The system includes an access module configured to access log data associated with a well. The log data includes at least one of permeability values or porosity values associated with a plurality of formation areas. The system includes one or more hardware processors configured to identify a formation area of the plurality of formation areas as a treatment candidate area based on at least one of a permeability value associated with the formation area exceeding a permeability threshold value or a porosity value associated with the formation area exceeding a porosity threshold value. The one or more hardware processors configured to determine, based on reservoir modelling, a current depth of invasion value associated with the formation area. The current depth of invasion value indicates a time-dependent dynamic invasion by drilling mud into the formation area. The one or more hardware processors configured to determine a volume of drilling mud buildup in the formation area based on the current depth of invasion value. The one or more hardware processors configured to determine a treatment fluid volume value that identifies a volume of treatment fluid for application to the formation area to remove the formation damage from the formation area during a formation damage removal process. The determining of the treatment fluid volume value is based on the volume of drilling mud buildup in the formation area.

In general, in one aspect, embodiments disclosed herein relate to a non-transitory machine-readable storage medium comprising instructions that, when executed by one or more processors of a machine, cause the machine to perform a method. The method includes accessing log data associated with a well. The log data includes at least one of permeability values or porosity values associated with a plurality of formation areas. The method includes identifying a formation area of the plurality of formation areas as a treatment candidate area based on at least one of a permeability value associated with the formation area exceeding a permeability threshold value or a porosity value associated with the formation area exceeding a porosity threshold value. The method includes determining, based on reservoir modelling, a current depth of invasion value associated with the formation area. The current depth of invasion value indicates a time-dependent dynamic invasion by drilling mud into the formation area. The method includes determining a volume of drilling mud buildup in the formation area based on the current depth of invasion value. The method includes determining a treatment fluid volume value that identifies a volume of treatment fluid for application to the formation area to remove the formation damage from the formation area during a formation damage removal process. The determining of the treatment fluid volume value is based on the volume of drilling mud buildup in the formation area.

Other aspects and advantages of the claimed subject matter will be apparent from the following description and the appended claims.

BRIEF DESCRIPTION OF DRAWINGS

Some embodiments are illustrated by way of example and not limitation in the figures of the accompanying drawings.

DETAILED DESCRIPTION

Figure 1A:
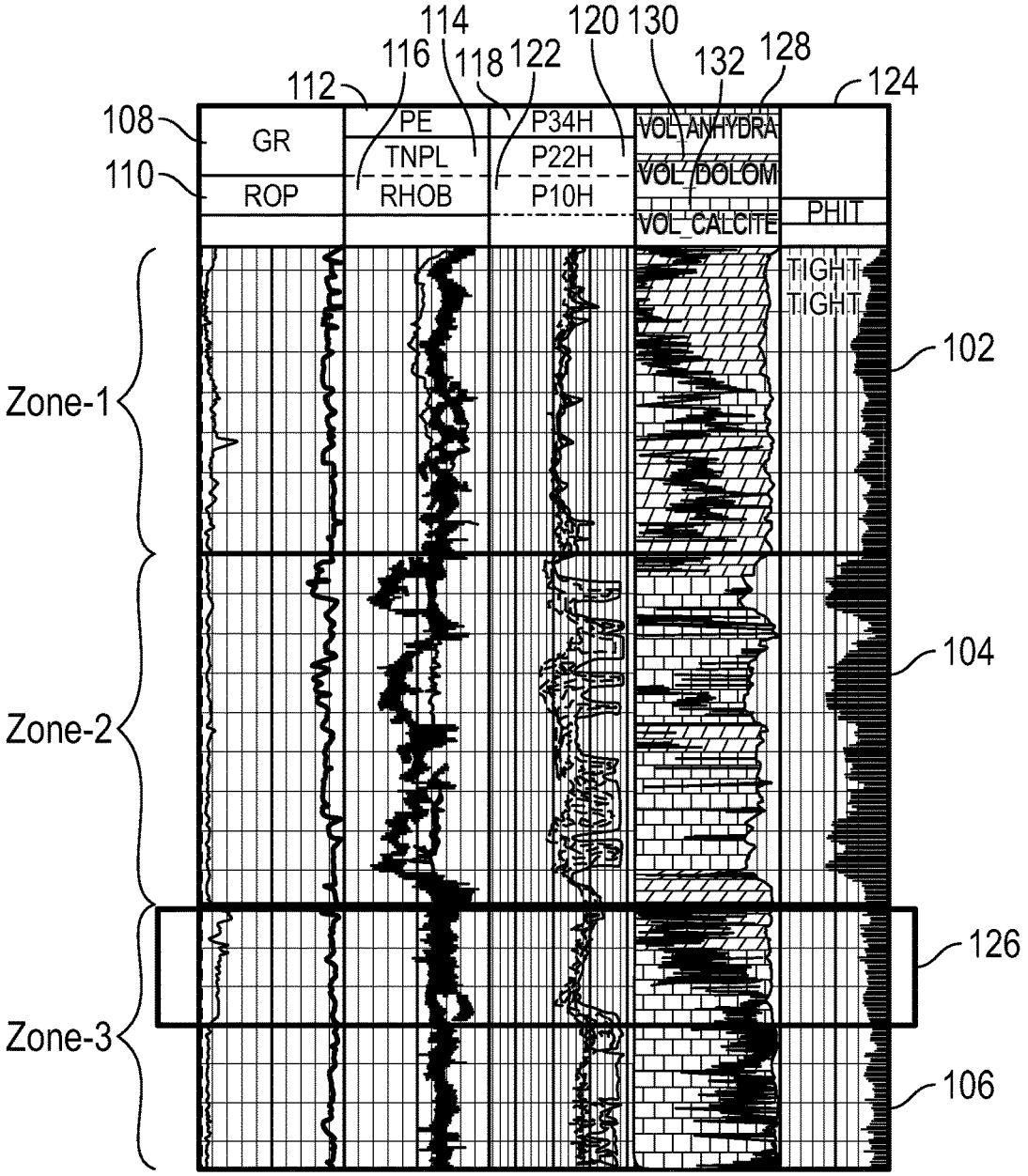
FIGS. 1A and 1B are illustrations of open hole logs associated with a well, according to one or more example embodiments.

Example systems and methods for volumetric treatment fluid distribution to remove formation damage are described. Unless explicitly stated otherwise, components and functions are optional and may be combined or subdivided. Similarly, operations may be combined or subdivided, and their sequence may vary.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein relate to a new, more efficient approach for acid treatment of damaged formation areas to improve the currently used method of acid stimulation by determining the magnitude of damage that has occurred in the formation, determining an adequate volume of acid to be applied to the damaged formation area, and selectively treating the damaged formation area with the adequate volume of acid. Embodiments disclosed herein quantify acid volumetric distribution per depth (e.g., interval of the wellbore which exhibits certain petrophysical characteristics) of the well, needed to treat a specific formation during matrix acidization operations. This is achieved through the utilization of petrophysical properties derived from well logs obtained during the drilling phase to further analyze and quantify formation damage. Using tornado charts, the initial depth of invasion may be determined and used to estimate the current invasion depth. The results may be used as an input in material balance equations to identify the required acid volume per depth. This novel method will aid to restore and enhance wells' performance by pumping the required amount of acid and optimize the treatment volume.

In some example embodiments, a quantification system utilizes an algorithm for volumetric treatment fluid distribution to remove formation damage from a formation area that has been determined to be a treatment candidate area. The treatment candidate area may be selected from a plurality of formation areas associated with a well. The treatment fluid may include an acid or another fluid that may remove mudcake buildup from the damaged formation area when applied to the damaged formation area.

The treatment candidate area may be selected, by the quantification system, based on analysis of open-hole logs obtained during drilling operations. The quantification system may also utilize the open-hole logs to identify the depth of drilling mud invasion and rock properties (hereinafter also "petrophysical data") of the formation area selected for treatment. In some instances, the depth of drilling mud invasion and the petrophysical data may serve as basis for determining the volume of drilling mud buildup in the selected formation area and the volume of treatment fluid to be applied to the selected formation area to cause the removal of the formation damage. For example, one or more material balance equations, rock quality information derived from the petrophysical data, and at least one of a resistivity log, a porosity log, or a permeability log, obtained during the drilling phase are utilized to determine the acid treatment volume distribution per depth value.

The quantification system improves upon the results of the Matrix Acidization technique by employing a systematic approach to distribution of a particular volume of acid at a particular depth based on the calculated magnitude of formation damage at the particular depth. This method helps to restore and enhance the performance of wells by treating a particular formation zone with the amount of acid that is adequate to remove the damage at the particular depth associated with the selected formation area rather than spotting an entire open-hole interval associated with a well with a generic volume of acid.

A benefit of the quantification system is its increased efficiency as compared to a conventional acid stimulation system based on the volumetric distribution of the acid to remove formations damage. An additional benefit is the prolonging of the life of the well by sustaining the oil production or facilitating additional oil production from the well while minimizing environmental damage by targeting specific formation areas with targeted volumes of acid that are computed to remove specific volumes of drilling mud buildup in the particular formation areas.

Figure 1B:
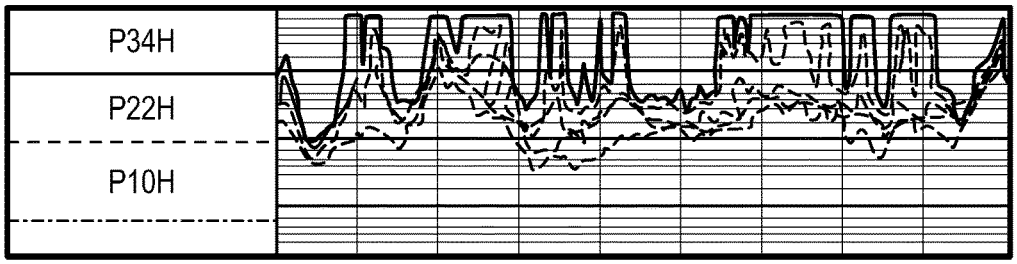

FIGS. 1A and 1B are illustrations of open hole logs associated with a well, according to one or more example embodiments. Well logging is a formation evaluation technique used to estimate the formation rock properties, such as resistivity, density, or gamma ray (GR) count. A common well logging package obtained during drilling or workover is called "triple combo" and refers to obtaining the three principal measurements pertaining to rock properties: density, porosity, and resistivity, in addition to the GR count.

Logs are obtained using various electrical, mechanical, or nuclear tools conveyed using wirelines after drilling or with a bottom hole assembly (BHA) during drilling. A gamma ray receiver may be placed in the BHA to count gamma rays coming from each formation bed. These readings differ from one formation to another and can be used as a signature for each specific formation. Further, these readings may be helpful in identifying lithological properties of each formation and in in selecting a pay zone with preferred rock qualities.

Porosity is a measurement that estimates the volume of the pore spaces in a formation area taking into considerations the electron density and the count of hydrogen atoms through the number of neutrons in the formation at a basic level. Because these correlations take porosity as a base value, it is important to ensure the accuracy of the obtained porosity values. Once obtained, the porosity values are implemented in empirical equations derived from data correlations that are cross-checked with core data and numerical models, if available for a specific reservoir, to generate point-to-point permeability estimates.

Because permeability is not directly measurable by well logging, the permeability of a formation zone is determined using numerical correlations with porosity and fluid saturation. Several studies in the industry have defined the direct poro-perm relationship where permeability increases the more porous the formation is (e.g., the Kozeny-Carman equation and the Berg equation). Permeability differs in a multiple fluid system where fluid saturation is introduced as a second variable in such correlations in order to define permeability accurately. Multiple equations are developed and used in the industry to incorporate saturation values (e.g., the Wyllie and Rose first and second equations, the Timur equation, and the Morris and Biggs equation).

Further, permeability differs in a multiple fluid system where fluid saturation is introduced as a second variable in such numerical correlations in order to define permeability accurately. As core data is the only real source for permeability data, the interpreted values are often cross checked with the core data to double check and correct the values when needed.

The density log is another log that may be used to identify the density and porosity of a formation. A radioactive source may be placed in the logging BHA to send medium to high energy gamma rays to the formation through Compton scattering. A receiver measures the number of dispersed gamma rays which can be related to electron density and converted to formation density. The formation density can be utilized with fluid density and known matrix density to calculate the porosity of the formation using the following ratio:

$$\frac{\rho_{matrix} - \rho_{bulk}}{\rho_{matrix} - \rho_{fluid}},$$

where P-matrix is the density of rock formation without porosity depending on the lithology of the reservoir, P-bulk is the density value directly measured from the wellbore including both matrix and void spaces, and P-fluid is the density of formation fluid.

Another log that aims to quantify the porosity of the formation can be obtained using a neutron tool. This tool contains another radioactive source that emits high energy neutrons and a receiver that collects the produced gamma rays from the neutrons' collision with the formation nuclei in addition to the returning neutrons. Accordingly, because they have the same size as the neutron particles, the number of hydrogen atoms in the formation can be measured, and a new porosity estimation can be interpreted. Multiple environmental corrections are applied to this porosity value such as borehole size, salinity, mud properties, etc. to generate an accurate estimate.

A resistivity tool produces an electric log that aims to detect the resistivity of the formation. The resistivity log is obtained by sending an electric current through the formation and recording its response. The resistivity log is utilized in the evaluation of the formation, specifically when calculating fluid saturation in reservoirs. Utilizing Archie's equation, $$S_w = \sqrt[n]{\frac{aRw}{\varphi^m R}},$$

where $S_W$ is water saturation, $R_W$ is formation water resistivity, Φ is porosity, R is formation resistivity, m is cementation factor, n is saturation exponent, and a is a constant, resistivity values and porosity values can be applied as inputs to calculate formation water saturation and, as a result, the hydrocarbon saturation.

FIG. 1A illustrates open-hole log general trends pertaining to a number of measurements obtained in a formation during drilling operations. More specifically, FIG. 1A shows an example of distinguishing adequate rock properties. The various rock properties include Gamma Ray (GR) 108, Rate of Penetration (ROP) 110, Photoelectric Density (PE) 112, Thermal Neutron Porosity or Neutron Log (TNPL) 114, Bulk Density (RHOB) 116, Phase Shift Resistivity thirty-four inches environmentally corrected or the Deep Resistivity Log (P34H) 118, Phase Shift Resistivity twenty-two inches environmentally corrected or the Medium Resistivity Log (P22H) 120, Phase Shift Resistivity ten inches environmentally corrected or the Shallow Resistivity Log (P10H) 122, an interpretation of the volume of Anhydrite in the total formation content at the current depth, VOL_ANHYDRA 128, an interpretation of the volume of Dolomite in the total formation content at the current depth, VOL_DOLOM 130, an interpretation of the volume of Calcite in the total formation content at the current depth. VOL_CALCITE 130, and Total Cross-plot Porosity (PHIT) 124. The formation interval represented in FIG. 1A is divided into three zones, Zone-1 102, Zone-2 104, and Zone-3 106, based on log responses and rock properties.

In the first interval, Zone-1 102, a gap is found between the density value (e.g., between 2.67 and 2.8, as shown in FIG. 1A) and the neutron reading (e.g., about 0.15, as shown in FIG. 1A). A density value between 2.67 and 2.8 indicates a denser formation. Such a formation that also has a higher amount of hydrogen often represents dolomite in carbon reservoirs. The crossplot porosity was calculated showing a peak of 16% with an average of 12% which is considered low for the targeted reservoir and, in turn, correlates to lower permeability values for such reservoir. The crossplot porosity is the porosity obtained by plotting two porosity logs against each other, normally, density and neutron porosity.

The three resistivity logs (e.g., the deep resistivity log, the medium resistivity log, and the shallow resistivity log) shown in FIG. 1A as items 118, 120, and 122, respectively, are reading almost the same value. This indicates that no drilling mud invasion has occurred in Zone-1 102. In other words, these resistivity readings indicate that, due to poor rock properties, mud filtrate could not penetrate the wellbore wall, which indicates that Zone-1 102 is a tight formation. Further, formation testing was conducted at two depths in the interval to measure the mobility and formation pressure, but no fluid has moved at either point towards the probe confirming that this interval is a tight dolomitic formation.

Thus, the log interpretation indicates that this interval has poor qualities and should not be targeted as a zone of interest.

The second interval, Zone-2 104, shows different log responses and, thus, different rock properties. A general increase in porosity can be observed as the gap between the neutron log and the density log gets smaller and eventually overlay at higher neutron values indicating more pore spaces while density is reading lower. The crossplot porosity shows an average of 22%, which correlates to higher permeability, which in turn indicates better rock quality. A contrast between the three different resistivity logs shown in FIG. 1A as items 118, 120, and 122, respectively, appear to indicate invasion and possible formation damage in Zone-2 104. The deep resistivity log reads much higher resistivity values than the shallow resistivity log, while the medium resistivity log shows a good example of invaded, transition, and virgin zones. The low shallow resistivity reading corresponds to the mud filtrate in the invaded zone where sodium chloride brine was used to drill the well, which is known to be very conductive. Once the three electric currents induced by the resistivity tool (at different frequencies giving different depths of investigations) pass through the formation, three values of resistivity are received that represent the shallow, medium, and deep formation resistivity, respectively. The resistivity values in this specific interval appear to have higher readings deep in the formation while the shallow part is reading less. In other words, the deep log shows higher values than the medium log, which in turn shows higher values than the shallow log. This corresponds to the fact that the formation water is less conductive than the mud filtrate which is valid based on the drilling fluid properties in this well.

The second interval, Zone-2 104, shows good porosity values and resistivity. These values indicate invasion, less dolomitic content, and a porous carbonate bed in Zone-2 104. Thus, Zone-2 104 shows good rock qualities and can be targeted during a formation damage removal process (hereinafter also "a formation damage removal program," "a formation damage removal operation," "an acidization program," "an acidization process," or "an acidization operation") to enhance injectivity and remove possible formation damage.

With respect to Zone-3 106, the first few blocks from Zone-3 106 (e.g., area 126) are very similar to Zone-1 102—the gap between the density and neutron logs appears, while the three resistivity logs show no contrast representing dolomitic features. Starting from the middle of the third block to the end of the interval, neutron and density logs are overlaying at almost 5-7% throughout the whole interval. This yields a crossplot porosity similar to Zone-1 102. This indicates that Zone-3 106 has low porosity and correlates to low permeability. The three resistivity logs for Zone-3 106, on the other hand, shows a contrast in resistivity readings. It is noticeable that the deep resistivity log reaches its maximum and continues as such all the way to the end of the interval. This is referred to as a close anhydrite bed that affects the deep log reading and partially the medium log. As the tool gets closer to the anhydrite bed at the end of Zone-3 106, the medium log reaches its maximum, too. Anhydrite is known for its dense and thick properties, as it acts as a seal for reservoirs but not as an injection interest zone. Based on the log interpretation, Zone-3 106 should not be targeted during the acidization program as it contains a low porosity and tight carbonate layer with inadequate rock properties.

Accordingly, based on log interpretation using the open-hole logs shown in FIG. 1A, Zone-2 104 is chosen for fluid treatment due to having higher porosity and permeability values represented by the PHIT graph in column 124, in addition to the contrast between the three different resistivity logs shown in FIG. 1A as items 118, 120, and 122, respectively. The contrast between the three different resistivity logs of Zone-2 104 are magnified in FIG. 1B.

Figure 2:
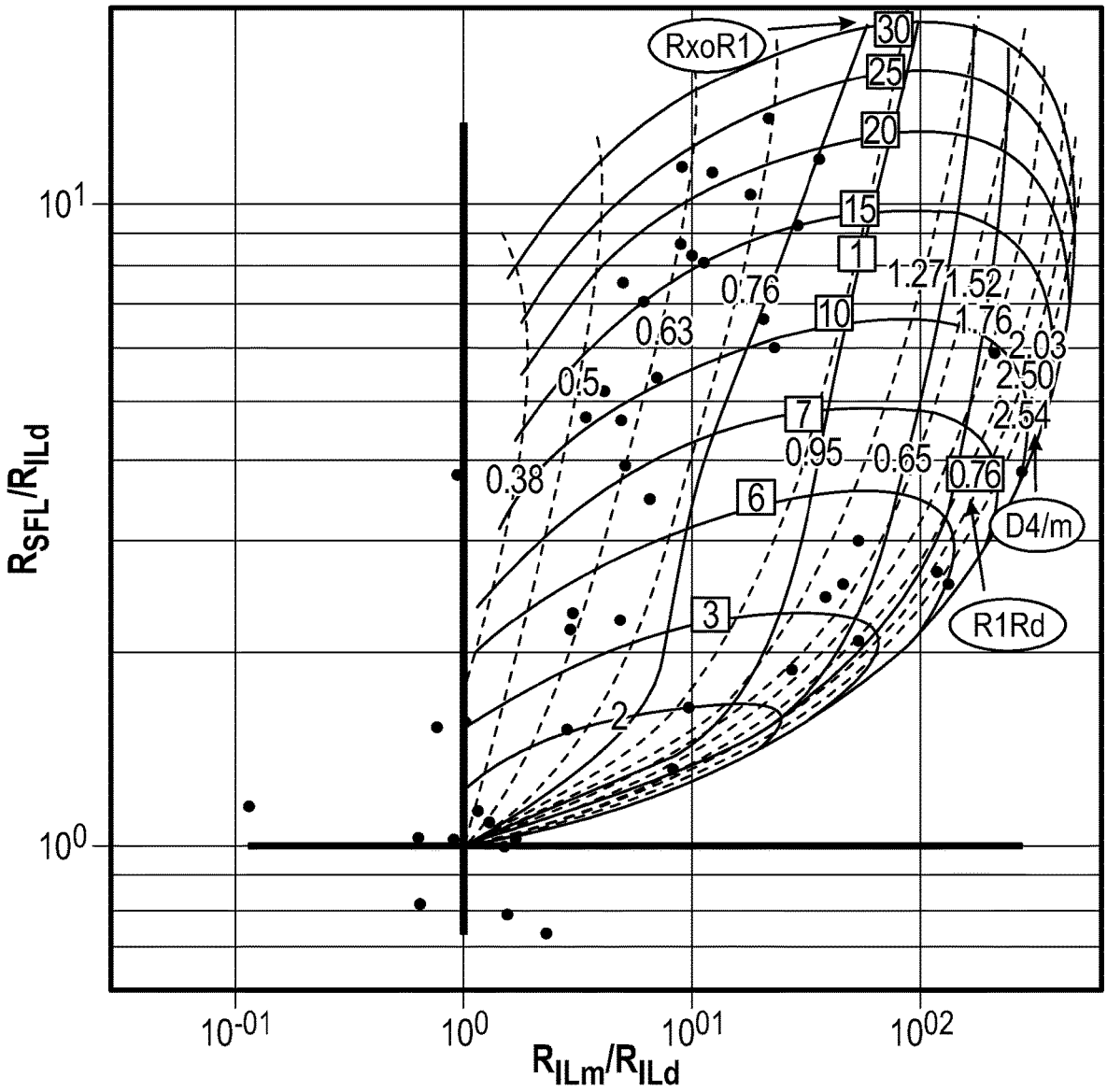
FIG. 2 is a resistivity tornado chart used to determine invasion and true resistivity specifications, according to one or more example embodiments.

FIG. 2 is a resistivity tornado chart used to determine invasion and true resistivity specifications, according to one or more example embodiments. The tornado chart consists of an x-axis that represents the ratio between the medium resistivity value and the deep resistivity value, and a y-axis that represents the ratio between the shallow resistivity value and the deep resistivity. The resistivity values are obtained from the resistivity logs. As shown in FIG. 2, inside the tornado chart, there are two curved vertical lines. The solid line represents the depth of invasion while the dashed line represents the true formation resistivity ratio to the deep resistivity. Also, a curved horizontal line represents the flushed zone resistivity to the true resistivity. Once the shallow, medium and deep readings are plotted on the graph, the flushed zone and true resistivity readings can be interpreted in addition to the depth of invasion. Using tornado charts and reservoir modelling, the quantification system may determine a depth of drilling mud invasion and may quantify the amount of plugging in the invaded pore spaces at the zone of interest. These methods may use the shallow, medium, and deep resistivity logs, obtained using the transmitters and receivers in the logging tool, as inputs to an algorithm for computing the specification of true resistivity and invasion parameters. An example of invasion parameters is the flushed zone resistivity which represents the mud filtrate resistivity inside the very shallow part of the wellbore and can be used as a guide to where the transition between the invaded zone and virgin zone starts.

In some example embodiments, resistivity logs are run with at least three depths of investigations and resolutions based on the spacing between the transmitters and receivers during drilling or immediately afterwards. Thus, at least three logs from the resistivity tool can be obtained and can be classified as "shallow," "medium," and "deep." Identifying resistivity at different depths in the formation can give qualitative and even quantitative specifications of formation damage using tornado charts and wellbore modeling. The ratios between the different resistivity values obtained from well logs are utilized as inputs to determine the initial depth of invasion using the tornado chart. Such charts require two inputs: the ratio between the shallow and the deep resistivity, and the ratio between the medium resistivity and the deep resistivity. By plotting the ratios on the tornado chart, true resistivity, flushed zone resistivity, and invasion depth can be determined, by the quantification system, as initial values at each depth. Because it represents the invasion during or right after drilling, the initial depth of invasion can be used as a baseline when determining the thickness of invasion at the formation area of interest. In order to present a realistic representation of the time-dependent dynamic invasion of the formation area, the quantification system may generate a synthetic model based on fluid saturations values, salinity values, and differential pressure values between the borehole and original reservoir among other measurements. Such a synthetic model requires solving a few equations such as fluid flow equations, dispersion equation, and Archie's equation.

The idea behind fluid flow equations is conservation of mass, energy, and momentum. To describe the invasion in a realistic way, time is considered as a factor that controls invasion. Thus, according to some example embodiments, the first step in calculating the invasion depth at a specific time is to identify the dynamic invasion profile starting from drilling forward. The fluid saturation dependent on time can be calculated based on the following equations:

$$\nabla \cdot \left( \frac{\rho_w k k_{rw}}{\mu_w} \nabla P_w \right) + q_w = \frac{\partial}{\partial t} (\varphi \rho_w S_w)$$

$$\nabla \cdot \left( \frac{\rho_o k k_{ro}}{\mu_o} \nabla P_O \right) + q_o = \frac{\partial}{\partial t} (\varphi \rho_O S_o),$$

where $S_w$ is water saturation, $S_o$ is oil saturation, $p_w$ is formation water density, $p_o$ is oil density, $\Phi$ is porosity, k is permeability, $k_{rw}$ is relative permeability of water, $k_{ro}$ is relative permeability of oil, $\mu_o$ is oil viscosity, $\mu_w$ is water viscosity, $P_w$ is pressure depletion while flowing water, and $P_o$ is pressure depletion while flowing oil.

These equations can be solved to present the saturation of fluid as a function of both time and distance inside the formation using p, k, kr, u, q and phi values as constants for our specific well.

As stated above, according to some example embodiments, the first step is to identify the invasion profile around the wellbore. The quantification system may utilize fluid flow equations to identify the saturation around the wellbore at different times and depths. Because the difference between the salinity of the mud and the salinity of the original reservoir fluid may greatly influence the resistivity measurements, the synthetic model should consider the salinity values to accurately compute the true resistivity value. The differential dispersion equation, the formation resistivity equation, and Archie's equation are used to solve for the true resistivity as a function of time and distance, as shown in the equations below:

$$\frac{1}{r} \frac{\partial}{\partial t} \left( \frac{r k k_{rw} C_w}{\mu_w} \frac{\partial P_w}{\partial r} \right) + q_w C_{mf} = \frac{\partial (\varphi S_w C_w)}{\partial t}$$

$$R_w(r, t) = \left( 0.00123 + \frac{3647.5}{C_w^{0.955}(r, t)} \right) \cdot \frac{82}{1.8T + 39}$$

$$R_f(r, t) = \frac{a R_w(r, t)}{S_w^n(r, t) \varphi^m}$$

where k is absolute permeability, t is invasion time, $S_w$ is water saturation, $R_w$ is formation water resistivity, $q_w$ is water flowrate, r is wellbore radius, $C_w$ is water salinity, $C_{mf}$ is mud filtrate salinity, $p_w$ is formation water density, $p_o$ is oil density, $\Phi$ is porosity, $k_{rw}$ is relative permeability of water, $\mu_o$ is oil viscosity, $\mu_w$ is water viscosity, $P_w$ is pressure depletion while flowing water, (r,t) is function of time and distance, m is cementation factor, n is saturation exponent, and a is a constant. Using these equations in the synthetic model facilitate the determination of the true formation resistivity value as a function of both time and distance inside the formation. Once the true formation resistivity value is identified, it can be cross-checked with log measurement at zero time (i.e., the log readings immediately after drilling) as a checkpoint. The distance between the borehole and the unaffected area can be determined as a function of time and can be used to identify the current depth of invasion. Knowing the depth of invasion inside the reservoir per every foot drilled for the zone of interest around the wellbore enables identifying the volume of fluid that has invaded into the reservoir. These values can be used in material balance equations to solve for filtrate buildup and the required volume required to be pumped at a certain depth. Thus, selective acid volume pumping can be carried out using jetting tools to ensure efficient stimulating of the damaged section rather than treating a plurality of open hole sections with the same acid volume.

Once the current invasion depth is identified using the synthetic dynamic model, it can be plotted as a log side by side with the initial values. The comparison between both values serves as basis for identifying the thickness of the invasion at every foot. The quantification system may use a caliper log to determine the wellbore profile and, thus, compute the invasion volume per specific point. The caliper log measures the size of the wellbore at each depth drilled. Based on the depth of invasion inside the reservoir, the depth reached by the fluids in the reservoir can be determined. Based on these values, the volume of the imperfect cylinder that represents the invasion around the wellbore can be determined.

In some instances, using lab experiments, various simulation fluids can be tested to determine, based on the rock properties, fluid properties, and downhole pressure, the most efficient fluid to deteriorate the plugging. For example, the type of acid or treatment fluid to remove the damage is identified through lab analysis of formation lithology and reservoir fluid. Once identified, the quantification system performs a numerical simulation of the formation damage removal process and uses lab results as input into the numerical simulation in order to identify a simulated optimal volume of the treatment fluid. Simulation results are then used to correlate to an actual optimal volume of the treatment fluid based on actual damage parameters.

The determined actual optimal volume of the treatment fluid can contribute to an optimization in both duration and cost of the formation damage removal process (e.g., a matrix acidization operation). Once the volume of acid required to remove the damage is identified per depth, it can be referenced by one or more commands (hereinafter also "instructions") to a fluid treatment jetting tool to treat the damaged section in a targeted way rather than washing the whole wellbore with fluid treatment. This may prevent further damage to the formation and may result in the additional benefits of increasing the production of the well, and reducing the treatment volume, duration of the formation damage removal process, and the overall cost.

Figure 3:
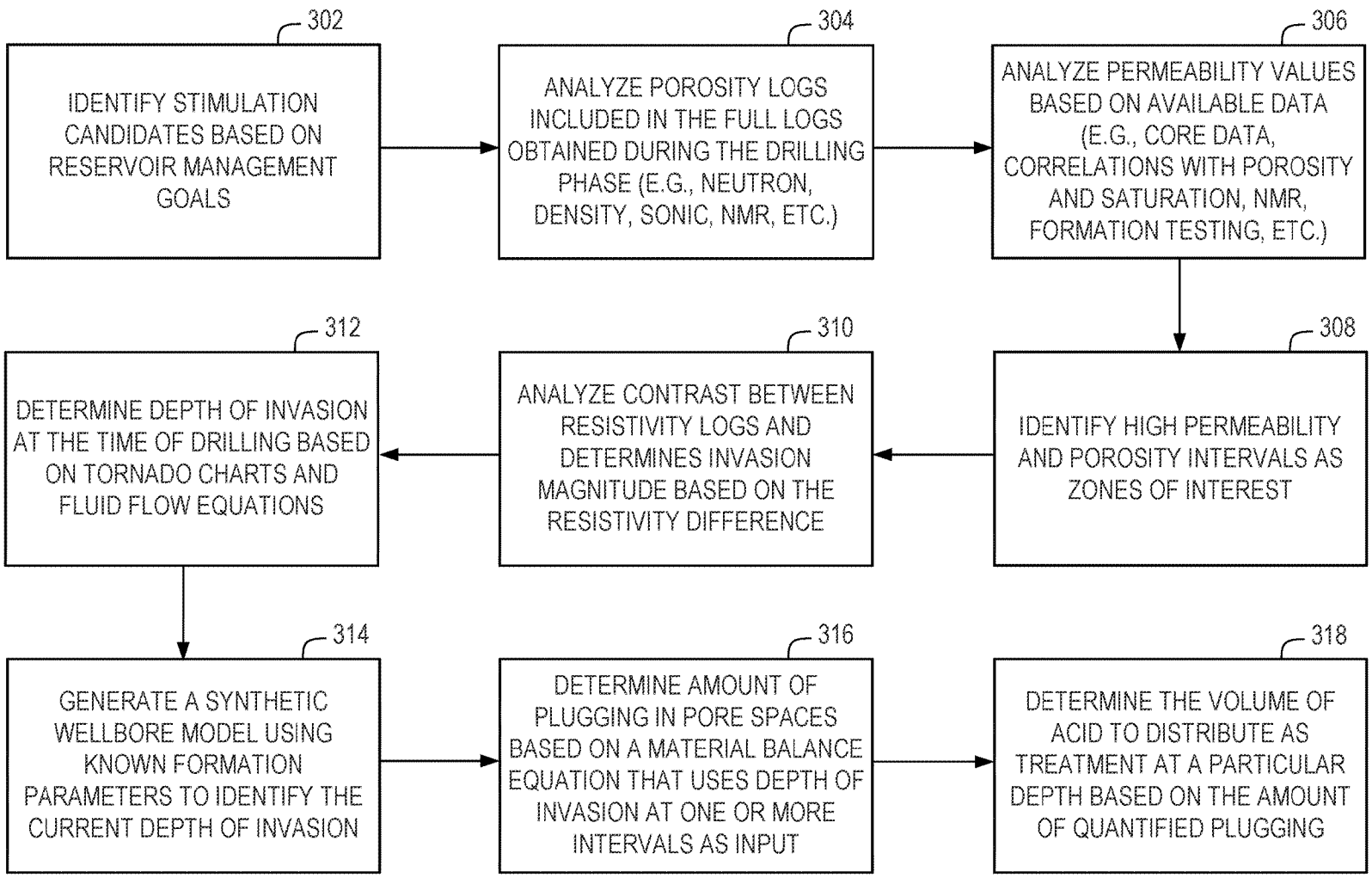
FIG. 3 is a flow diagram that illustrates an algorithm for volumetric treatment fluid distribution to remove formation damage, according to one or more example embodiments.
Figure 7A:
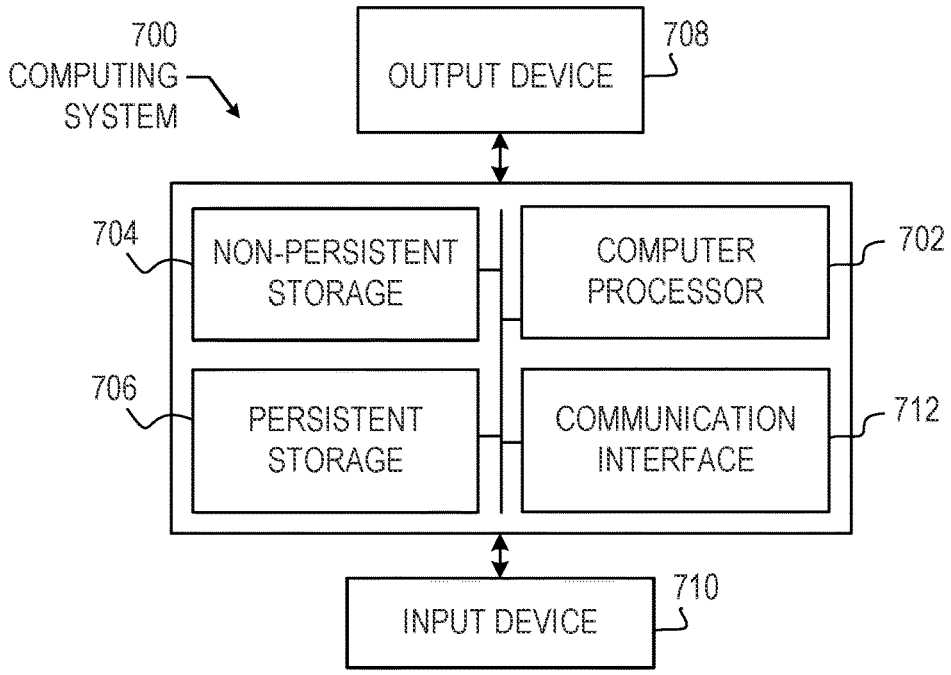
FIGS. 7A and 7B illustrate a computing system, according to one or more example embodiments.

FIG. 3 is a flow diagram that illustrates an algorithm for volumetric treatment fluid distribution to remove formation damage, according to one or more example embodiments. The algorithm described in FIG. 3 may be performed by a quantification system as described above and shown in FIG. 4, reference number 414. The algorithm of FIG. 3 may be executed on any suitable combination of hardware and software, such as a computing device as shown in FIG. 7A below. Further, steps of the algorithm shown in FIG. 3 may be performed in parallel, in series, may be omitted or combined, without departing from the scope disclosed herein.

As shown in FIG. 3, at Step 302, the quantification system identifies stimulation formation area candidates based on reservoir management goals determined by reservoir management engineers. The reservoir management engineers observe injection and production rates, perform various tests to identify the productivity and injectivity indices, and identify candidates for productivity and injectivity enhancement based on the results of the performed tests. At Step 304, the quantification system analyzes the porosity logs included in the full logs obtained during the drilling phase. Examples of the full logs include neutron logs, density logs, and Nuclear Magnetic Resonance (NMR). NMR is an advanced logging technique that could yield an additional porosity value which can be cross-checked with crossplot neutron density.

At Step 306, the quantification system analyzes the permeability values based on the available data, such as core data, correlations with porosity and saturation values, NMR, if available, and formation testing data. Formation testing is a technique to measure the pressure and permeability of the formation at a specific point where a probe is placed at the wellbore wall at a specific depth measuring the formation pressure, fluid type, mobility and consequently permeability. This advanced technique gives a permeability value at one specific depth unlike logging where there are continuous measurements and thus it can be used a cross-check point with the interpreted data. At Step 308, the quantification system identifies high permeability and porosity intervals as zones of interest.

At Step 310, the quantification system analyzes the contrast between a plurality of resistivity logs obtained at various depths and determines the invasion magnitude based on the resistivity difference. As discussed above, three logs are obtained at three depths (e.g., deep, medium, and shallow) of investigations. The difference between the resistivity values shows the extension of invasion inside the formation. At Step 312, the quantification system determines the depth of invasion into the formation area at the time of drilling based on utilizing one or more tornado charts and one or more flow fluid equations.

At Step 314, the quantification system generates a synthetic wellbore model using known formation parameters to identify the current depth of invasion. At Step 316, the quantification system determines the amount of plugging in the pore spaces of the formation area based on a material balance equation that uses the depth of invasion at one or more intervals as input. At Step 318, the quantification system determines the volume of acid to distribute as treatment at a particular depth based on the amount of quantified plugging.

Figure 4:
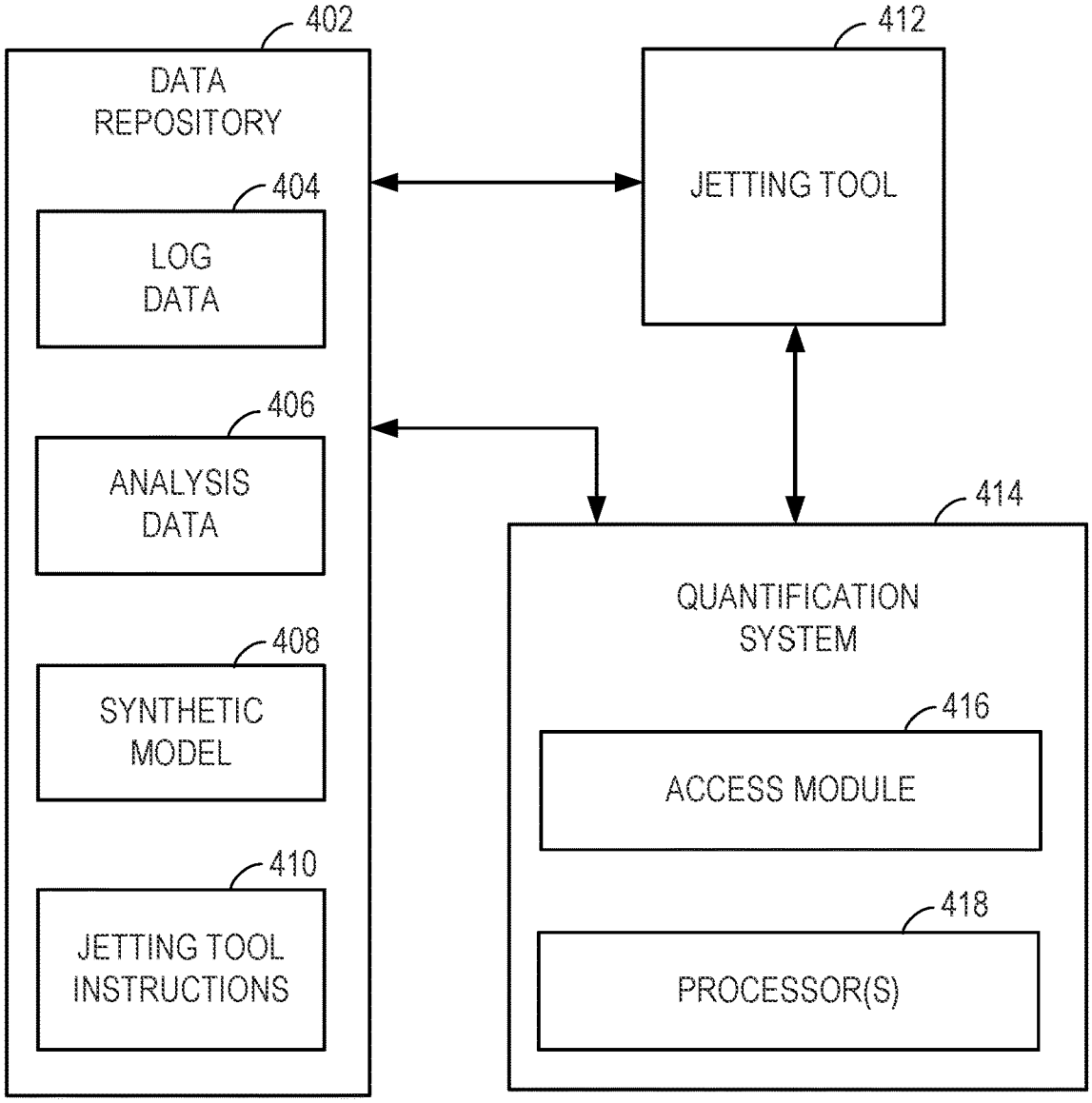
FIG. 4 is a block diagram that illustrates a quantification system, according to one or more example embodiments.

FIG. 4 is a block diagram that illustrates a quantification system, according to one or more example embodiments. In FIG. 4, the quantification system 414 is configured to communicate with a jetting tool 412 and a data repository 402. The quantification system 414 is shown as including an access module 416 and one or more processors 418. The access module 416 accesses log data associated with a well. The log data may be stored as log data 404 in a database of the data repository 402. The data repository 402 may be any type of storage, such as non-persistent storage (e.g., random access memory (RAM), cache memory, or flash memory), one or more persistent storage (e.g., a hard disk), or any other suitable type of memory capable of storing data within data structures such as arrays, lists, tables, etc.

The analysis module 418 (e.g., a processor) identifies a formation area of the plurality of formation areas as a treatment candidate area based on at least one of a permeability value associated with the formation area exceeding a permeability threshold value or a porosity value associated with the formation area exceeding a porosity threshold value. The analysis module 418 determines, based on reservoir modelling, a current depth of invasion value associated with the formation area. The current depth of invasion value indicates a time-dependent dynamic invasion by drilling mud into the formation area. The analysis module 418 determines a volume of drilling mud buildup in the formation area based on the current depth of invasion value. In some example embodiments, the volume of drilling mud buildup in the formation area is further based on petrophysical data of the formation. In some instances, the analysis module 418 determines a volume of drilling mud buildup in the formation area based on a material balance equation that uses the current depth of invasion and petrophysical data of the formation area as inputs. The analysis module 418 determines a treatment fluid volume value that identifies a volume of treatment fluid for application to the formation area to remove the formation damage from the formation area during a formation damage removal process. The determining of the treatment fluid volume value is based on the volume of drilling mud buildup in the formation area.

The analysis module 418 may be implemented using hardware (e.g., one or more processors of a machine) or a combination of hardware and software. For example, the analysis module 418 may configure a processor to perform the operations described herein for the analysis module 418. According to another example, the analysis module 418 is a hardware processor that performs the operations described herein for the analysis module 418. In some example embodiments, the analysis module 418 may be distributed across multiple machines or devices.

The data repository 402, in addition to storing the log data 404, may also store analysis data 406, a synthetic model 408, and jetting tool instructions 410. The analysis data 406 may include one or more types of data generated by the analysis module 418 during the operation of the quantification system 414, such as an identifier of the formation area identified as a treatment candidate area, the current depth of invasion value, the value representing the volume of drilling mud buildup, and the volume of treatment fluid for application to the formation area. The analysis data 406 may also include various lab data including petrophysical data of the formation area (e.g., formation lithology data), and reservoir fluid data.

The synthetic model 408 may be generated as part of determining the current depth of invasion value associated with the formation area, and may be used, by the quantification system 414, to determine the current depth of invasion value associated with the formation area.

The jetting tool instructions 410 may be generated for the jetting tool 412 to treat the formation area with a volume of treatment fluid corresponding to the treatment fluid volume value. The jetting tool instructions 410 may reference the treatment fluid volume value. The jetting tool 412 may execute the jetting tool instructions 410 during the formation damage removal process. The executing of the jetting tool instructions 410 includes applying the volume of treatment fluid corresponding to the treatment fluid volume value to the formation area. The executing of the jetting tool instructions 410 causes removal of at least a portion of the formation damage from the formation area. In some instances, the analysis module 418 (e.g., a processor of a machine) causes the execution of the jetting tool instructions 410 by the jetting tool 412.

Figure 5:
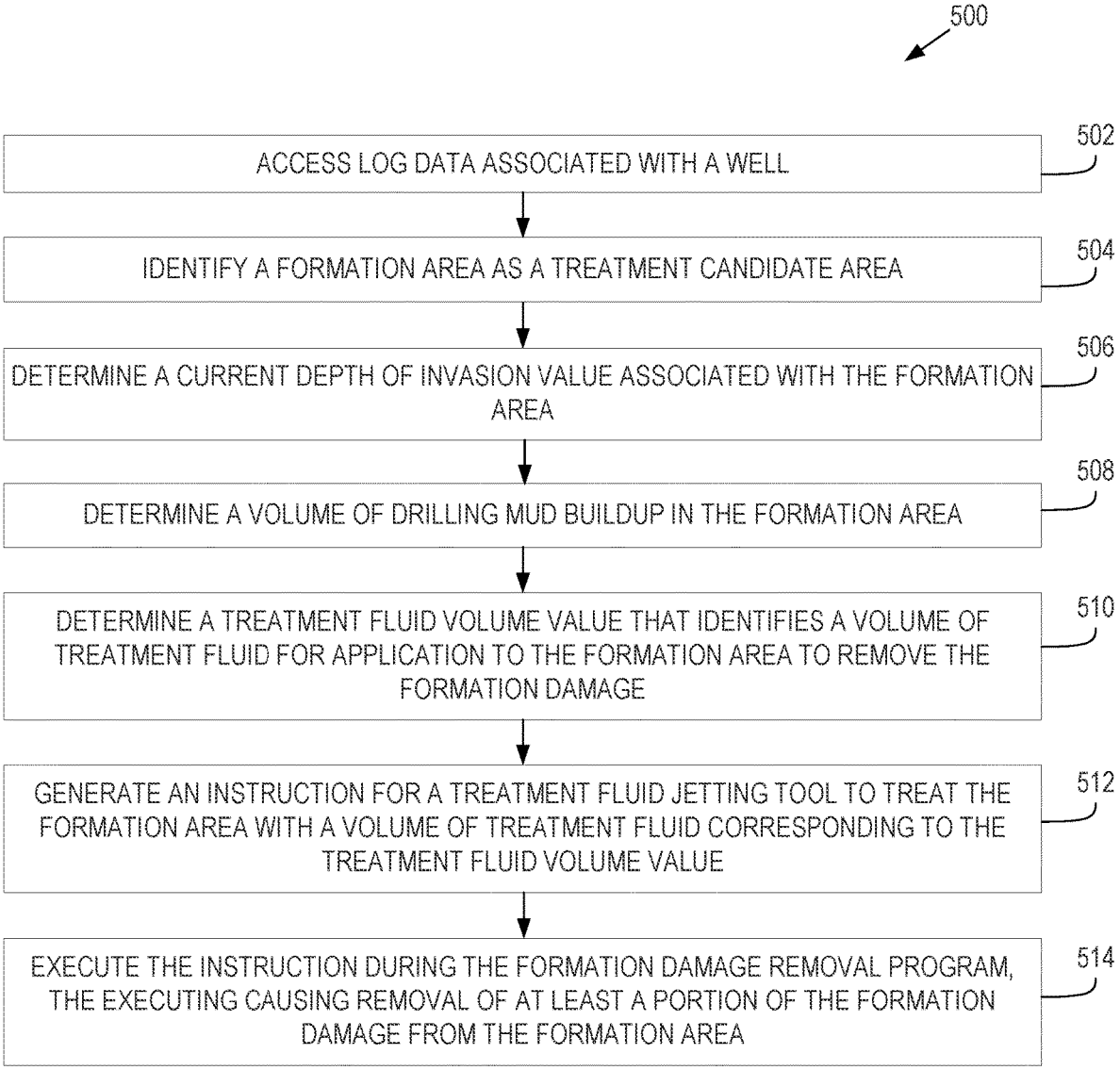
FIGS. 5 and 6 are flowcharts illustrating operations of the quantification system in performing a method for volumetric treatment fluid distribution to remove formation damage, according to one or more example embodiments.
Figure 6:
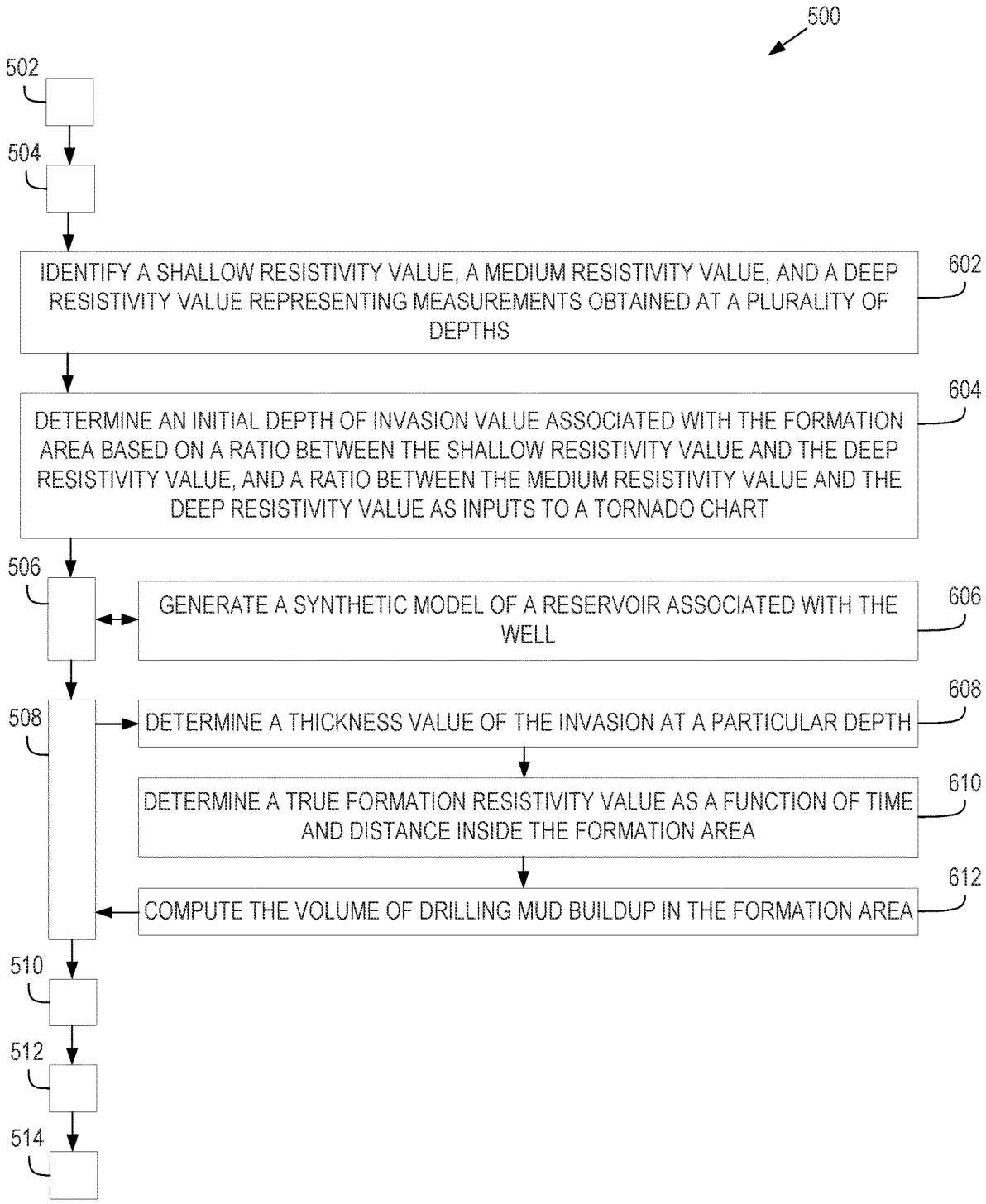

FIGS. 5 and 6 are flowcharts illustrating operations of the quantification system in performing a method for volumetric treatment fluid distribution to remove formation damage, according to one or more example embodiments. Operations of the method 500 may be performed using the components described above with respect to FIG. 4. One or more blocks in FIGS. 5 and 6 may be performed by a computing system such as that shown and described below in FIGS. 7A and 7B. While the various blocks in FIGS. 5 and 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As shown in FIG. 5, at Step 502, the access module 416 accesses log data associated with a well. The log data includes at least one of permeability values or porosity values associated with a plurality of formation areas. In some example embodiments, the log data is included in open hole logs obtained during drilling operations associated with the well. The log data may further include at least one of density values, resistivity values, or gamma ray values associated with a plurality of formation areas. The accessed log data may include the log data 404 stored in the data repository 402 of FIG. 4.

At Step 504, a processor (e.g., the one or more processors 418 of FIG. 4) identifies a formation area as a treatment candidate area. The identifying of the formation area as a treatment candidate may be based on at least one of a permeability value associated with the formation area exceeding a permeability threshold value or a porosity value associated with the formation area exceeding a porosity threshold value.

In various example embodiments, the identifying of the formation area as the treatment candidate area is further based on a comparison of a plurality of resistivity values obtained at a plurality of depths of the well indicating the drilling mud invasion into the formation area. For example, the comparison is initiated at every single depth between the different resistivity readings obtained at one specific depth independently and then compared to the resistivity values at other depths. This will yield a comprehensive picture of the invasion inside the whole wellbore. To this end, comparisons are performed between the multiple resistivity values at one specific depth and then another comparison is performed between the multiple resistivity values and other resistivity values at the other depths, as well.

At Step 506, the processor determines a current depth of invasion value associated with the formation area. The current depth of invasion value indicates a time-dependent dynamic invasion by drilling mud into the formation area. The determining of the current depth of invasion value may be based on reservoir modelling.

At Step 508, the processor determines a volume of drilling mud buildup in the formation area. The determining of the volume of drilling mud buildup in the formation area may be based on the current depth of invasion. In some example embodiments, the determining of the volume of drilling mud buildup in the formation area is based on a material balance equation that uses the current depth of invasion and petrophysical data of the formation area as inputs.

In some example embodiments, the determining of the current depth of invasion value associated with the formation area includes generating a resistivity tornado chart based on a plurality of resistivity logs obtained at a plurality of depths of the well by spacing one or more transmitters and one or more receivers in a logging tool. The determining of the current depth of invasion value further includes computing true resistivity and invasion parameters based on analyzing the resistivity tornado chart. The true resistivity and invasion parameters are used as additional inputs for the material balance equation. Examples of inputs for the material balance equation are oil formation factor, water formation factor, oil viscosity, water viscosity, rock compressibility, interest zone thickness, permeability, horizontal permeability, vertical permeability, wellbore pressure, pressure drainage difference, reservoir drainage radius, wellbore radius, gas oil ratio, water saturation, oil saturation, water density, oil density, time, and production rate of each fluid.

At Step 510, the processor determines a treatment fluid volume value that identifies a volume of treatment fluid for application to the formation area to remove the formation damage from the formation area during a formation damage removal process. The determining of the treatment fluid volume value may be based on the volume of drilling mud buildup in the formation area. In some example embodiments, the treatment fluid includes an acid.

In some example embodiments, the determining of the treatment fluid volume value for treatment of the formation area includes identifying a type of treatment fluid based on analysis of formation lithology data and reservoir fluid data. The determining of the treatment fluid volume value further includes identifying, using a numerical simulation of the formation damage removal process and based on the type of treatment fluid, a correlation between simulation damage parameters and a simulated treatment fluid volume value for the formation area. The treatment fluid volume value is determined based on applying the correlation to actual damage parameters associated with the formation area.

At Step 512, the processor generates an instruction for a treatment fluid jetting tool to treat the formation area with the volume of treatment fluid corresponding to the treatment fluid volume value.

At Step 514, the processor executes the instruction during the formation damage removal process. The executing of the instructions causes removal of at least a portion of the formation damage from the formation area. Further details with respect to the operations of the method 500 are described below with respect to FIG. 6.

As shown in FIG. 6, the method 500 may include additional steps, according to some example embodiments. Step 602 may be performed after Step 504, in which the processor identifies the formation area as the treatment candidate area. At Step 602, the processor identifies, based on the log data, a shallow resistivity value, a medium resistivity value, and a deep resistivity value associated with the formation area. The shallow resistivity value, the medium resistivity value, and the deep resistivity value represent measurements obtained during well logging at a plurality of depths of the well by spacing one or more transmitters and one or more receivers in a logging tool associated with the well.

At Step 602, the processor determines an initial depth of invasion value associated with the formation area. The initial depth of invasion value may be determined based on utilizing a first ratio between the shallow resistivity value and the deep resistivity value, and a second ratio between the medium resistivity value and the deep resistivity value as inputs to a tornado chart.

Step 606 may be performed as part of (e.g., a precursor task, a subroutine, or a portion) of Step 506, in which the processor determines the current depth of invasion value associated with the formation area. At Step 606, the processor generates a synthetic model of a reservoir associated with the well. The generating of the synthetic model may be based on at least one of a plurality of fluid saturation values, a plurality of salinity values, or a plurality of differential pressure values between a borehole and the reservoir in an original state. The plurality of fluid saturation values, the plurality of salinity values, and the plurality of differential pressure values are obtained at a plurality of times and a plurality of depths of the well. The synthetic model utilizes at least one of a fluid flow equation, a dispersion equation, or Archie's equation to determine the current depth of invasion value associated with the formation area.

Steps 608, 610, and 612 may be performed as part of (e.g., a precursor task, a subroutine, or a portion) of Step 508, in which the processor determines the volume of drilling mud buildup in the formation area. At Step 608, the processor determines a thickness value of the invasion at a particular depth of the wellbore. The thickness value may be determined based on comparing the initial depth of invasion value associated with the formation area and the current depth of invasion value associated with the formation area.

At Step 610, the processor determines a true formation resistivity value as a function of time and distance inside the formation area. The true formation resistivity value may be determined based on at least one of a formation saturation value associated with a particular time and the particular depth, a salinity value of a mud, or a salinity value of an original reservoir fluid.

At Step 612, the processor computes the volume of drilling mud buildup in the formation area. The volume of drilling mud buildup may be based on the thickness value of the invasion at the particular depth and the true formation resistivity value at the particular depth.

Example embodiments may be implemented on a computing system. Any combination of mobile, desktop, server, router, switch, embedded device, or other types of hardware may be used. For example, as shown in FIG. 7A, the computing system 700 may include one or more computer processors 702, non-persistent storage 704 (e.g., volatile memory, such as random access memory (RAM) or cache memory), persistent storage 706 (e.g., a hard disk, an optical drive such as a compact disk (CD) drive or digital versatile disk (DVD) drive, or a flash memory), a communication interface 712 (e.g., Bluetooth interface, infrared interface, network interface, or optical interface), and numerous other elements and functionalities.

The computer processor(s) 702 may be an integrated circuit for processing instructions. For example, the computer processor(s) 702 may be one or more cores or micro-cores of a processor. The computing system 700 may also include one or more input devices 710, such as a touchscreen, keyboard, mouse, microphone, touchpad, or electronic pen.

The communication interface 712 may include an integrated circuit for connecting the computing system 700 to a network (not shown) (e.g., a local area network (LAN), a wide area network (WAN), such as the Internet, mobile network, or any other type of network) or to another device, such as another computing device.

Further, the computing system 700 may include one or more output devices 708, such as a screen (e.g., a liquid crystal display (LCD), a plasma display, touchscreen, cathode ray tube (CRT) monitor, or projector), a printer, external storage, or any other output device. One or more of the output devices may be the same or different from the input device(s). The input and output device(s) may be locally or remotely connected to the computer processor(s) 702, non-persistent storage 704, and persistent storage 706. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s) is configured to perform one or more embodiments of the disclosure.

Figure 7B:
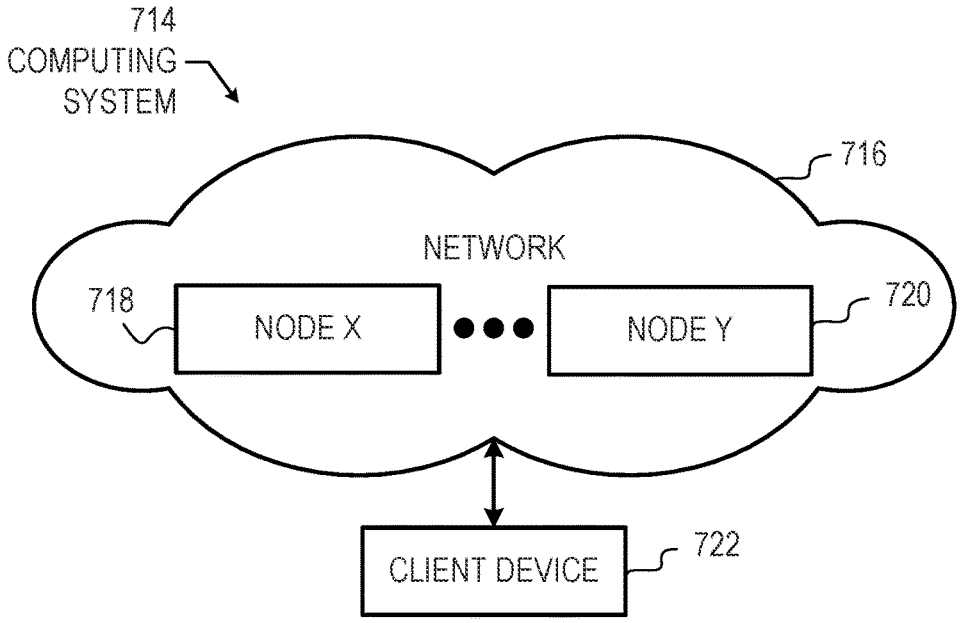

The computing system 700 in FIG. 7A may be connected to or be a part of a network. For example, as shown in FIG. 7B, the network 716 may include multiple nodes (e.g., node X 718 or node Y 720). Each node may correspond to a computing system, such as the computing system shown in FIG. 7B, or a group of nodes combined may correspond to the computing system shown in FIG. 7B. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the afore-mentioned computing system 714 may be located at a remote location and connected to the other elements over a network.

Although not shown in FIG. 7B, the node may correspond to a blade in a server chassis that is connected to other nodes via a backplane. By way of another example, the node may correspond to a server in a data center. By way of another example, the node may correspond to a computer processor or micro-core of a computer processor with shared memory or resources.

The nodes (e.g., node X 718 or node Y 720) in the network 716 may be configured to provide services for a client device 722. For example, the nodes may be part of a cloud computing system. The nodes may include functionality to receive requests from the client device 722 and transmit responses to the client device 722. The client device 722 may be a computing system, such as the computing system shown in FIG. 7B. Further, the client device 722 may include or perform all or a portion of one or more embodiments of the disclosure.

The previous description of functions presents only a few examples of functions performed by the computing system of FIG. 7A and the nodes or client device in FIG. 7B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed. Accordingly, the scope of the disclosure should be limited only by the attached claims.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method for selective fluid treatment of formation areas to remove formation damage, the method comprising:

accessing log data associated with a well, the log data including at least one of permeability values or porosity values associated with a plurality of formation areas;

identifying, based on the log data, a shallow resistivity value, a medium resistivity value, and a deep resistivity value;

identifying, using a hardware processor, a formation area of the plurality of formation areas as a treatment candidate area based on at least one of a permeability value associated with the formation area exceeding a permeability threshold value or a porosity value associated with the formation area exceeding a porosity threshold value;

determining, based on utilizing a first ratio between the shallow resistivity value and the deep resistivity value and a second ratio between the medium resistivity value and the deep resistivity value as inputs to a resistivity tornado chart, an initial depth of invasion by drilling mud into the formation area;

obtaining a time-dependent synthetic model of a reservoir comprising:

a fluid flow equation, comprising a time derivative of a water density in the formation area, the water density based on a water saturation and a water salinity;

a formation resistivity equation based on the water salinity; and

Archie's equation based on the water saturation and the formation resistivity;

determining a current depth of invasion by drilling mud into the formation area using the hardware processor, the time-dependent synthetic model of a reservoir, and an initial water saturation for the fluid flow equation based on the initial depth of invasion;

determine a volume of drilling mud buildup in the formation area based on the current depth of invasion; and determining, using the hardware processor, a treatment fluid volume value that identifies a volume of treatment fluid for application to the formation area to remove the formation damage from the formation area during a formation damage removal process, the determining of the treatment fluid volume value being based on the volume of drilling mud buildup in the formation area.

2. The method of claim 1, wherein the log data is included in open hole logs obtained during drilling operations associated with the well, the log data further including at least one of density values, resistivity values, or gamma ray values associated with the plurality of formation areas.

3. The method of claim 1, wherein the identifying of the formation area as the treatment candidate area is further based on a comparison of a plurality of resistivity values obtained at a plurality of depths of the well indicating the drilling mud invasion into the formation area.

4. The method of claim 3, wherein a difference between a first resistivity value associated with a particular depth of the well and a second resistivity value associated with a different depth of the well exceeds a resistivity threshold value indicates that the drilling mud invasion into the formation area occurred at the particular depth.

5. The method of claim 1, wherein the determining of the volume of drilling mud buildup in the formation area is further based on a material balance equation that uses the current depth of invasion and petrophysical data of the formation area as inputs.

6. The method of claim 5, wherein the determining of the current depth of invasion associated with the formation area includes:

generating a resistivity tornado chart based on a plurality of resistivity logs obtained at a plurality of depths of the well by spacing one or more transmitters and one or more receivers in a logging tool; and computing true resistivity and invasion parameters based on analyzing the resistivity tornado chart, wherein the true resistivity and invasion parameters are used as additional inputs for the material balance equation.

7. The method of claim 1, wherein:

the shallow resistivity value, the medium resistivity value and the deep resistivity value represent measurements obtained during well logging at a plurality of depths of the well by spacing one or more transmitters and one or more receivers in a logging tool associated with the well;

the synthetic model of a reservoir is based on at least one of a plurality of fluid saturation values, a plurality of salinity values and a plurality of differential pressure values between a borehole and the reservoir in an original state; and the plurality of fluid saturation values, the plurality of salinity values and the plurality of differential pressure values are obtained at a plurality of times and a plurality of depths of the well.

8. The method of claim 7, wherein the determining of the volume of drilling mud buildup in the formation area includes:

determining a thickness value of the invasion at a particular depth of the wellbore based on comparing the initial depth of invasion associated with the formation area and the current depth of invasion associated with the formation area;

determining a true formation resistivity value as a function of time and distance inside the formation area based on at least one of a formation saturation value associated with a particular time and the particular depth, a salinity value of a mud, or a salinity value of an original reservoir fluid; and computing the volume of drilling mud buildup in the formation area based on the thickness value of the invasion at the particular depth and the true formation resistivity value at the particular depth.

9. The method of claim 1, wherein the determining of the treatment fluid volume value for treatment of the formation area includes:

identifying a type of treatment fluid based on analysis of formation lithology data and reservoir fluid data;

identifying, using a numerical simulation of the formation damage removal process and based on the type of treatment fluid, a correlation between simulation damage parameters and a simulated treatment fluid volume value for the formation area, wherein the treatment fluid volume value is determined based on applying the correlation to actual damage parameters associated with the formation area.

10. The method of claim 1, further comprising:

generating an instruction for a treatment fluid jetting tool to treat the formation area with the volume of treatment fluid corresponding to the treatment fluid volume value.

11. The method of claim 10, further comprising:

executing the instruction during the formation damage removal process, the executing causing removal of at least a portion of the formation damage from the formation area.

12. A system for selective fluid treatment of formation areas to remove formation damage, the system comprising:

an access module configured to access log data associated with a well, the log data including at least one of permeability values or porosity values associated with a plurality of formation areas; and one or more hardware processors configured to:

receive log data from the access module;

identify, based on the log data, a shallow resistivity value, a medium resistivity value, and a deep resistivity value;

identify a formation area of the plurality of formation areas as a treatment candidate area based on at least one of a permeability value associated with the formation area exceeding a permeability threshold value or a porosity value associated with the formation area exceeding a porosity threshold value;

determine, based on utilizing a first ratio between the shallow resistivity value and the deep resistivity value and a second ratio between the medium resistivity value and the deep resistivity value as inputs to a resistivity tornado chart, an initial depth of invasion by drilling mud into the formation area;

obtain a time-dependent synthetic model of a reservoir comprising:

a fluid flow equation, comprising a time derivative of a water density in the formation area, the water density based on a water saturation and a water salinity;

a formation resistivity equation based on the water salinity; and

Archie's equation based on the water saturation and the formation resistivity;

determine a current depth of invasion by drilling mud into the formation area using the time-dependent synthetic model of a reservoir and an initial water saturation for the fluid flow equation based on the initial depth of invasion;

determine a volume of drilling mud buildup in the formation area based on the current depth of invasion-value; and determine a treatment fluid volume value that identifies a volume of treatment fluid for application to the formation area to remove the formation damage from the formation area during a formation damage removal process, the determining of the treatment fluid volume value being based on the volume of drilling mud buildup in the formation area.

13. The system of claim 12, wherein the determining of the current depth of invasion associated with the formation area includes:

generating a resistivity tornado chart based on a plurality of resistivity logs obtained at a plurality of depths of the well by spacing one or more transmitters and one or more receivers in a logging tool; and computing true resistivity and invasion parameters based on analyzing the resistivity tornado chart, wherein the determining of the volume of drilling mud buildup in the formation area is further based on a material balance equation that uses the current depth of invasion and petrophysical data of the formation area as inputs, wherein the true resistivity and invasion parameters are used as additional inputs for the material balance equation.

14. The system of claim 12, wherein:

the shallow resistivity value, the medium resistivity value and the deep resistivity value represent measurements obtained during well logging at a plurality of depths of the well by spacing one or more transmitters and one or more receivers in a logging tool associated with the well;

the synthetic model of a reservoir is based on at least one of a plurality of fluid saturation values, a plurality of salinity values and a plurality of differential pressure values between a borehole and the reservoir in an original state; and the plurality of fluid saturation values, the plurality of salinity values and the plurality of differential pressure values are obtained at a plurality of times and a plurality of depths of the well.

15. The system of claim 14, wherein the determining of the volume of drilling mud buildup in the formation area includes:

determining a thickness value of the invasion at a particular depth of the wellbore based on comparing the initial depth of invasion value associated with the formation area and the current depth of invasion value-associated with the formation area;

determining a true formation resistivity value as a function of time and distance inside the formation area based on at least one of a formation saturation value associated with a particular time and the particular depth, a salinity value of a mud, or a salinity value of an original reservoir fluid; and computing the volume of drilling mud buildup in the formation area based on the thickness value of the invasion at the particular depth and the true formation resistivity value at the particular depth.

16. The system of claim 12, wherein the determining of the treatment fluid volume value for treatment of the formation area includes:

identifying a type of treatment fluid based on analysis of formation lithology data and reservoir fluid data;

identifying, using a numerical simulation of the formation damage removal process and based on the type of treatment fluid, a correlation between simulation damage parameters and a simulated treatment fluid volume value for the formation area, wherein the treatment fluid volume value is determined based on applying the correlation to actual damage parameters associated with the formation area.

17. The system of claim 12, wherein the one or more hardware processors are further configured to:

generate an instruction for a treatment fluid jetting tool to treat the formation area with the volume of treatment fluid corresponding to the treatment fluid volume value; and execute the instruction during the formation damage removal process, the executing causing removal, using a jetting tool, of at least a portion of the formation damage from the formation area.

18. A non-transitory machine-readable storage medium comprising instructions that, when executed by one or more processors of a machine, cause the machine to perform a method comprising:

accessing log data associated with a well, the log data including at least one of permeability values or porosity values associated with a plurality of formation areas;

identifying, based on the log data, a shallow resistivity value, a medium resistivity value, and a deep resistivity value;

identifying a formation area of the plurality of formation areas as a treatment candidate area based on at least one of a permeability value associated with the formation area exceeding a permeability threshold value or a porosity value associated with the formation area exceeding a porosity threshold value;

determining, based on utilizing a first ratio between the shallow resistivity value and the deep resistivity value and a second ratio between the medium resistivity value and the deep resistivity value as inputs to a resistivity tornado chart, an initial depth of invasion by drilling mud into the formation area;

obtaining a time-dependent synthetic model of a reservoir comprising:

a fluid flow equation, comprising a time derivative of a water density in the formation area, the water density based on a water saturation and a water salinity;

a formation resistivity equation based on the water salinity; and

Archie's equation based on the water saturation and the formation resistivity;

determining a current depth of invasion by drilling mud into the formation area using the time-dependent synthetic model of a reservoir and an initial water saturation for the fluid flow equation based on the initial depth of invasion determining a volume of drilling mud buildup in the formation area based on the current depth of invasion; and determining a treatment fluid volume value that identifies a volume of treatment fluid for application to the formation area to remove the formation damage from the formation area during a formation damage removal process, the determining of the treatment fluid volume value being based on the volume of drilling mud buildup in the formation area.

19. The non-transitory machine-readable storage medium of claim 18, wherein:

the shallow resistivity value, the medium resistivity value and the deep resistivity value represent measurements obtained during well logging at a plurality of depths of the well by spacing one or more transmitters and one or more receivers in a logging tool associated with the well;

the synthetic model of a reservoir is based on at least one of a plurality of fluid saturation values, a plurality of salinity values and a plurality of differential pressure values between a borehole and the reservoir in an original state; and the plurality of fluid saturation values, the plurality of salinity values and the plurality of differential pressure values are obtained at a plurality of times and a plurality of depths of the well.

20. The non-transitory machine-readable storage medium of claim 18, wherein the determining of the treatment fluid volume value for treatment of the formation area comprises:

identifying a type of treatment fluid based on analysis of formation lithology data and reservoir fluid data; and identifying, using a numerical simulation of the formation damage removal process and based on the type of treatment fluid, a correlation between simulation damage parameters and a simulated treatment fluid volume value for the formation area, wherein the treatment fluid volume value is determined based on applying the correlation to actual damage parameters associated with the formation area.

* * * * *